US005353507A

United States Patent [19]

Lee et al.

[11] Patent Number: 5,353,507

[45] Date of Patent: Oct. 11, 1994

[54] BEADING TOOL

[75] Inventors: Leonard G. Lee; Robin C. Lee, both of Ottawa; Francis A. McLean, Oxford Station, all of Canada

[73] Assignee: Lee Valley Tools Ltd., Ottawa, Canada

[21] Appl. No.: 105,594

[22] Filed: Aug. 12, 1993

[51] Int. Cl.[5] ..... B26B 5/00; B26B 9/02

[52] U.S. Cl. ..... 30/484; 30/491; 30/280

[58] Field of Search ..... 30/484, 485, 486, 487, 30/489, 491, 492, 481, 280, 281, 313, 314, 317, 344, 329; 144/134 D, 136 C

[56] References Cited

U.S. PATENT DOCUMENTS

| | | | |
|---|---|---|---|
| 32,617 | 6/1861 | Colton | 30/281 |
| 257,870 | 5/1882 | Humphrey | 30/281 |
| 326,435 | 9/1885 | Kendall et al. | 30/281 |
| 352,056 | 11/1886 | Hildebrand | 30/281 |
| 668,299 | 11/1901 | Traut | 30/281 |
| 1,955,395 | 4/1934 | Tueth | 30/281 |
| 4,103,421 | 8/1978 | Quenot | 30/335 X |
| 4,240,202 | 12/1980 | Gilbert | 30/336 X |
| 5,212,870 | 5/1993 | Chi | 30/481 |

OTHER PUBLICATIONS

Joyce, Ernest, *Encyclopedia of Furniture Making*, Sterling Publishing Co., Inc., 387 Park Avenue South, New York, N.Y. 10016 (1987), p. 211.

Chinn, Garry and Sainsbury, John, *The Garrett Wade Book of Wood Working Tools*, Copyright 1979 Quarto Publishing Limited, London, England, p. 140.

The Stanley Works, *Stanley Tools for Carpenters and Mechanics*, Catalog No. 129, Copyright 1929, The Stanley Works, p. titled "Hand Beaders".

*Primary Examiner*—Rinaldi I. Rada

*Attorney, Agent, or Firm*—Kilpatrick & Cody

[57] ABSTRACT

An adjustable beading and grooving tool having a combination handle and fence within which a blade holder telescopes. The holder is a longitudinally slotted cylinder having two holder arms, or may be two half-cylinders, between which a blade may be fixed to project a desired distance from the holder, thereby establishing the depth of workpiece surface penetration. The blade holder is separately, adjustably fixed in the handle with the blade located a desired distance from the fence surface to establish the location of the profile to be formed with respect to the workpiece edge against which the fence bears during use.

10 Claims, 1 Drawing Sheet

BEADING TOOL

BACKGROUND OF THE INVENTION

This invention relates to hand beaders, scratch stocks, scratch blocks and other devices for routing or forming beads, grooves and similar shapes in wood workpieces.

Tools called scratch stocks, scratch blocks or hand beading tools have long been used by cabinetmakers for forming grooves or other molded shapes in work pieces. Such grooves are formed, for instance, to receive inlaid strings and bands or, in the case of beads or other molded profiles, the shapes are themselves decorative elements. While the variety of possible profiles is endless and the names of recognized shapes are numerous, all profiles will be referred to herein as "grooves" or "beads."

Shop-made scratch stocks typically consist of a piece of hardwood slotted lengthwise to receive a steel cutter or blade that is locked within the slot with screws or bolts. The blade working edge is shaped to form the desired molded cross section, preferably with a 90° cutting edge so that it will cut in both backwards and forwards directions as the tool is moved along the workpiece to scratch or scrape the desired groove or molding profile.

A metal version of such a tool similar in appearance to a spokeshave uses an adjustable metal fence and blades that protrude through a slot in the sole of the tool.

Despite long use of such hand beaders and scratch stocks, there remains a need for an economical, versatile such tool that is easily adjustable and can accommodate a wide variety of cutters or blades.

SUMMARY OF THE INVENTION

The present invention is an adjustable beading and grooving tool having a combination handle and fence within which a blade holder telescopes. The holder is a longitudinally slotted cylinder having two holder arms, or may be two half-cylinders, between which a blade may be fixed within the holder to project a desired distance from the holder, thereby establishing the depth of workpiece surface penetration. The blade holder is separately, adjustably fixed in the handle with the blade located a desired distance from the fence surface to establish the location of the profile to be formed with respect to the workpiece edge against which the fence bears during use. The handle is a generally round grip with a head that defines the fence and with positions for the user's thumb in either right-handed or left-handed use. The end of the blade holder remote from the handle has a finger hold to be grasped by the thumb and forefinger of the user's other hand to facilitate two handed operation.

DETAILED DESCRIPTION OF THE DRAWINGS

Figure 1:
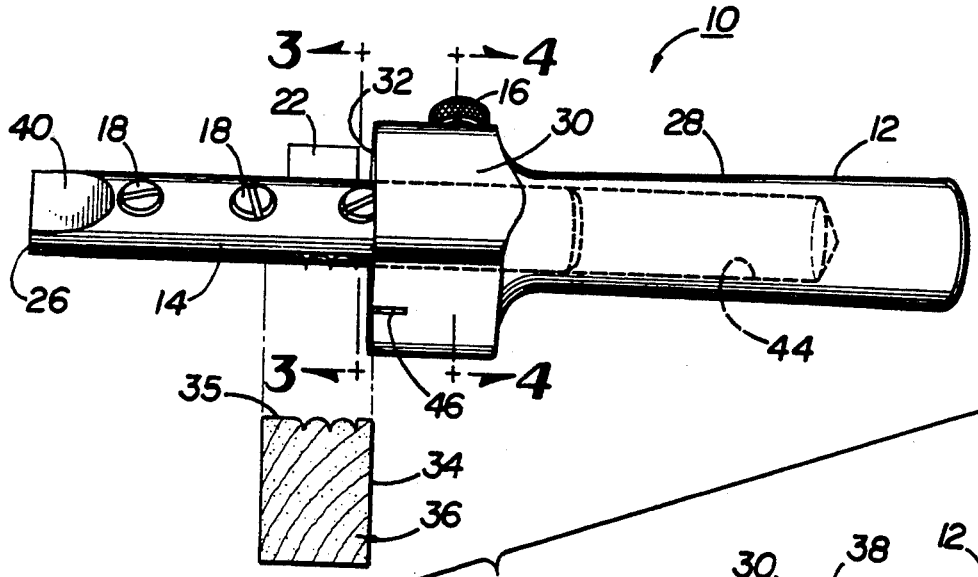
FIG. 1 is a bottom and side view of the beading tool of the present invention shown exploded away from a workpiece.

The beading tool 10 of the present invention includes a handle 12, blade holder 14, blade holder thumb screw or clamping screw 16, and blade locking screws 18 and nuts 20.

Blade holder 14 is generally a cylinder on the order, for instance, of approximately 5¾ inches (14.5 cm) long and ¾ inches (2 cm) in diameter. Holder 14 is split along a substantial portion of its length by a centered, longitudinal slot or kerf 26 slightly wider than the thickness of blades 22. For instance, slot 26 might typically be 0.032 to 0.038 inches thick. Holder 14 need not have a cylindrical shape, but could have other elongated shapes, including, for instance, ones having a generally elliptical, oval, square or rectangular cross-section. It is desirable, however, for the surface of holder 14 adjacent to blade 22 to be curved, at least gently, to facilitate use of the tool 10 without damaging the workpiece.

Figure 2:
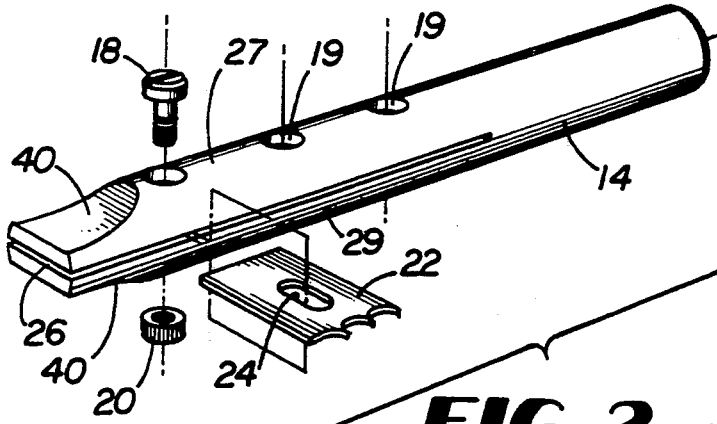
FIG. 2 is a perspective view of a portion of the handle, the blade holder and the blade of the beading tool shown in FIG. 1.

Slot 26 divides a portion of holder 14 into arms 27 and 29 between which blades such as blade 22 shown in FIGS. 1 and 2 may be grasped. Arms 27 and 29 are drawn together by blade holder screws 18 that pass through holes 19 that penetrate holder 14 and into nuts 20. Arms 27 and 29 could alternatively be separate, in the form, for instance, of two half-cylinders.

Blade 22 may be fixed in blade holder 14 between blade holder screws 18 as illustrated in FIG. 1 or, in the case of a blade 22 having an oval hole or slot 24 as illustrated in FIG. 2, by passing a screw 18 through the slot 24.

The heads of screws 18, and nuts 20, should be recessed below the surface of holder 14 such that when screws 18 are tightened neither screws 18 nor nuts 20 will contact the face 35 of the workpiece 36 or obstruct insertion of holder 14 into handle 12.

Figure 4:
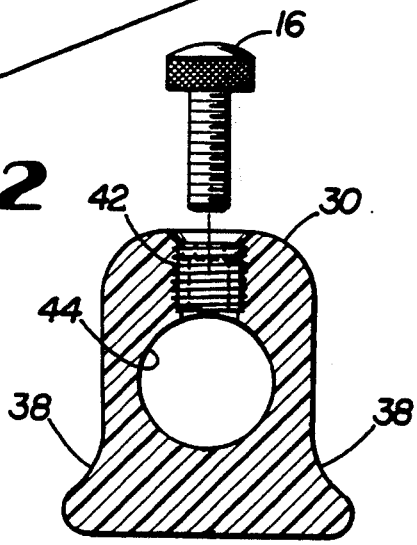
FIG. 4 is a section view taken along line 4—4 in FIG. 4 with the thumb screw shown out of the handle.

Handle 12 includes a grip 28 that may be a straight cylinder or, as shown, a gently tapered cylinder that flares into a head 30 having a cross-sectional shape best seen in FIGS. 2 and 4. The face 32 of handle 12 serves as a fence to ride against edge 34 of workpiece 36. As will be appreciated by one skilled in the art, an auxiliary fence may be attached to fence 32 to facilitate use of tool 10 on workpieces 36 having curved edges 34. Depressions 38 in the head 30 of handle 12 serve as thumb rests during the use of tool 10 when a user's fingers typically are wrapped around the grip 28 of handle 12 and a thumb on the same hand rests in one of the thumb rests 38. Scalloped or arcuate areas 40 removed from the remote end of blade holder 14 provide a finger hold that can be squeezed between the thumb and forefinger of a user's other hand.

Figure 3:
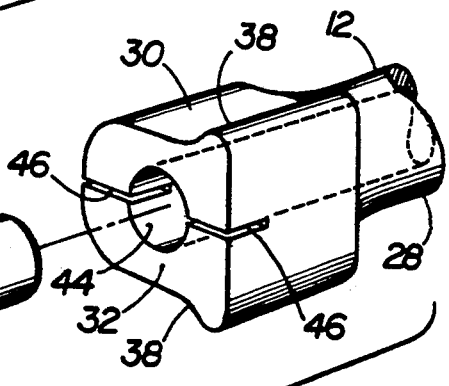
FIG. 3 is a section view taken along line 3—3 in FIG. 1.
Figure 3:
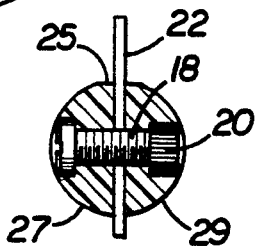

As is illustrated in FIG. 4, clamping screw 16 is received in a threaded insert 42 positioned in head 30 so that clamping screw 16 may project through the insert and bear against a flat surface 25 of holder 14 (visible in FIG. 3) when holder 14 has been inserted in a bore 44 in handle 12 coaxial with its longitudinal axis. Pressing clamping screw 16 against flat surface 25 facilitates proper alignment of holder 14 with handle 12 and resists rotation of holder 14 within bore 44 during use of tool 10. Alternatively, clamping screw 16 may press against a disk or plug (not shown) that floats in head 30 below insert 42 and, in turn, presses against the flat surface 25 of holder 14. Such a plug provides a greater bearing surface and protects holder 14. If flat surface 25 is stopped short of the end of holder 14 received by handle 12, the plug will also act as a stop preventing complete withdrawal of holder 14 unless handle 12 is turned upside down, permitting the plug to drop into the handle a sufficient distance entirely to clear holder 14 and permit its withdrawal.

Radial slots 46 in the same plane as the axis of bore 44 and penetrating face 32 are formed in handle head 30 to receive a cutter 22 when it is desirable to bury a portion of cutter 22 in head 30 of handle 12 so that only the remaining portion projects beyond fence 32. Such slots 46 may be on the order, for instance, of approximately 0.040 inch wide and approximately 0.5 inch deep.

As will be readily appreciated by those skilled in the art, the handle 12 and blade holder 14 of the present invention may be fabricated from a variety of suitable materials, including wood, metal and plastic, using appropriate machining, casting and molding techniques. An economical and particularly attractive material for handle 12 and holder 14 is hard maple. The clamping screw 16, screws 18, nuts 20, and threaded insert 42 can be a wide variety of materials but typically should be metal such as steel or brass. Blades 22 are typically steel but may also be other suitable cutting tool materials such as carbide. A very sharp steel blade (i.e., one having a crisp 90° cutting edge) may be produced using electro-discharge machining. While the profile on blade 22 may also be formed with a bevelled edge, use of a square edge permits the blade 22 to cut in either direction and facilitates cutting with the wood grain. By beginning with a trailing stroke with the blade tilted and slowly bringing the blade to an upright or nearly upright position after several strokes, tear-out is substantially avoided.

The foregoing description of this invention is for purposes of explanation and illustration. It will be apparent to those skilled in the art that modification and changes may be made to this invention without departing from its scope and spirit.

We claim:

1. A tool for removing material from a wood workpiece face located adjacent to an edge of the workpiece to form a profile in the face, comprising:

(a) a cylindrical blade holder having a longitudinal slot separating a portion of the holder into two arms between which a blade may be grasped for contact with the workpiece face and at least one screw passing through one arm and into the other arm to draw the arms together to grasp the blade, (b) a handle having (1) a generally cylindrical grip, (2) a face penetrated by a slot for receiving a portion of the blade and (3) a longitudinal bore for telescopically receiving a portion of the holder, and (c) means for adjustably fixing the holder within the bore during use.

2. The tool of claim 1, wherein the means for fixing the holder within the handle bore comprises a clamping screw threaded into the handle to apply pressure against the holder when it is positioned in the bore.

3. The tool of claim 1, further comprising a fingerhold associated with the holder and wherein the handle has at least one thumb recess.

4. The tool of claim 1, wherein the holder and handle are formed of plastic.

5. The tool of claim 1, wherein the handle and holder are formed of hardwood.

6. A tool for removing material from a wood workpiece face located adjacent to an edge of the workpiece to form a profile in the face, comprising:

(a) a cylindrical blade holder having a longitudinal slit separating a portion of the holder into two arms between which a blade may be grasped for contact with the workpiece face and (b) a handle having:

(1) a generally cylindrical grip having a longitudinal axis, (2) attached to the grip, a head having a fence surface normal to the longitudinal axis for contact with the workpiece edge during use of the tool, (3) coaxial with the longitudinal axis, a longitudinal bore penetrating the fence surface for receiving a first portion of the holder so that a second, remaining portion of the holder projects from the handle, (4) penetrating the fence surface, two radial slots to receive a portion of the blade when the holder is inserted into the handle, and (5) means for adjustably fixing the holder within the bore during use.

7. The tool of claim 6, further comprising at least one screw passing through one arm and into the other arm to draw the arms together to grasp a blade.

8. The tool of claim 6, wherein the means for fixing the holder within the handle bore comprises a clamping screw threaded into the handle to apply pressure against the holder when it is positioned in the bore.

9. The tool of claim 6, further comprising a fingerhold associated with the holder and wherein the handle has at least one thumb recess.

10. The tool of claim 6, wherein the holder and handle are formed of materials selected from the group consisting of metal, plastic and wood.

* * * * *